US006895797B2

(12) United States Patent
Lowry et al.

(10) Patent No.: US 6,895,797 B2
(45) Date of Patent: May 24, 2005

(54) PUNCH ASSEMBLY WITH FEED GAP MAXIMIZATION

(75) Inventors: Dennis K. Lowry, Princeton, MN (US); Christopher D. Morgan, Minneapolis, MN (US)

(73) Assignee: Mate Precision Tooling INC, Anoka, MN (US)

( * ) Notice: Subject to any disclaimer, the term of this patent is extended or adjusted under 35 U.S.C. 154(b) by 251 days.

(21) Appl. No.: 10/279,574

(22) Filed: Oct. 23, 2002

(65) Prior Publication Data

US 2004/0079134 A1 Apr. 29, 2004

(51) Int. Cl.[7] ..... B21D 37/00
(52) U.S. Cl. ..... 72/480; 72/482.94; 83/699.41
(58) Field of Search ..... 72/442, 480, 482.94; 83/552, 699.41

(56) References Cited

U.S. PATENT DOCUMENTS

| | | | | |
|---|---|---|---|---|
| 31,410 A | | 2/1861 | Schadt | |
| 268,767 A | | 12/1882 | Arnd et al. | |
| 2,660,245 A | | 11/1953 | Marsh | |
| 3,854,318 A | | 12/1974 | Korpeinen | |
| 5,056,391 A | | 10/1991 | Stewart | |
| 5,466,207 A | | 11/1995 | Arens | |
| 5,647,256 A | * | 7/1997 | Schneider | 83/140 |

* cited by examiner

*Primary Examiner*—Lowell A. Larson
(74) *Attorney, Agent, or Firm*—James V. Harmon

(57) ABSTRACT

A punch assembly for punching or forming sheet metal has a circumferentially extending, horizontally disposed supporting flange that is slideably mounted upon the body of the punch assembly as a part thereof for supporting the punch assembly on a punch press. A resilient tool retractor, e.g., one or more springs is provided within the punch assembly for retracting or elevating the body of punch assembly relative to the supporting flange. Provision is also made for enabling a person to manually change the tool length and thus the feed gap from the exterior of the punch assembly by controlling the distance that the upper forming tool, i.e., the punch extends downwardly below the supporting flange and a lock is provided for securely retaining it in a selected position.

15 Claims, 4 Drawing Sheets

PUNCH ASSEMBLY WITH FEED GAP MAXIMIZATION

FIELD OF THE INVENTION

Figure 1:
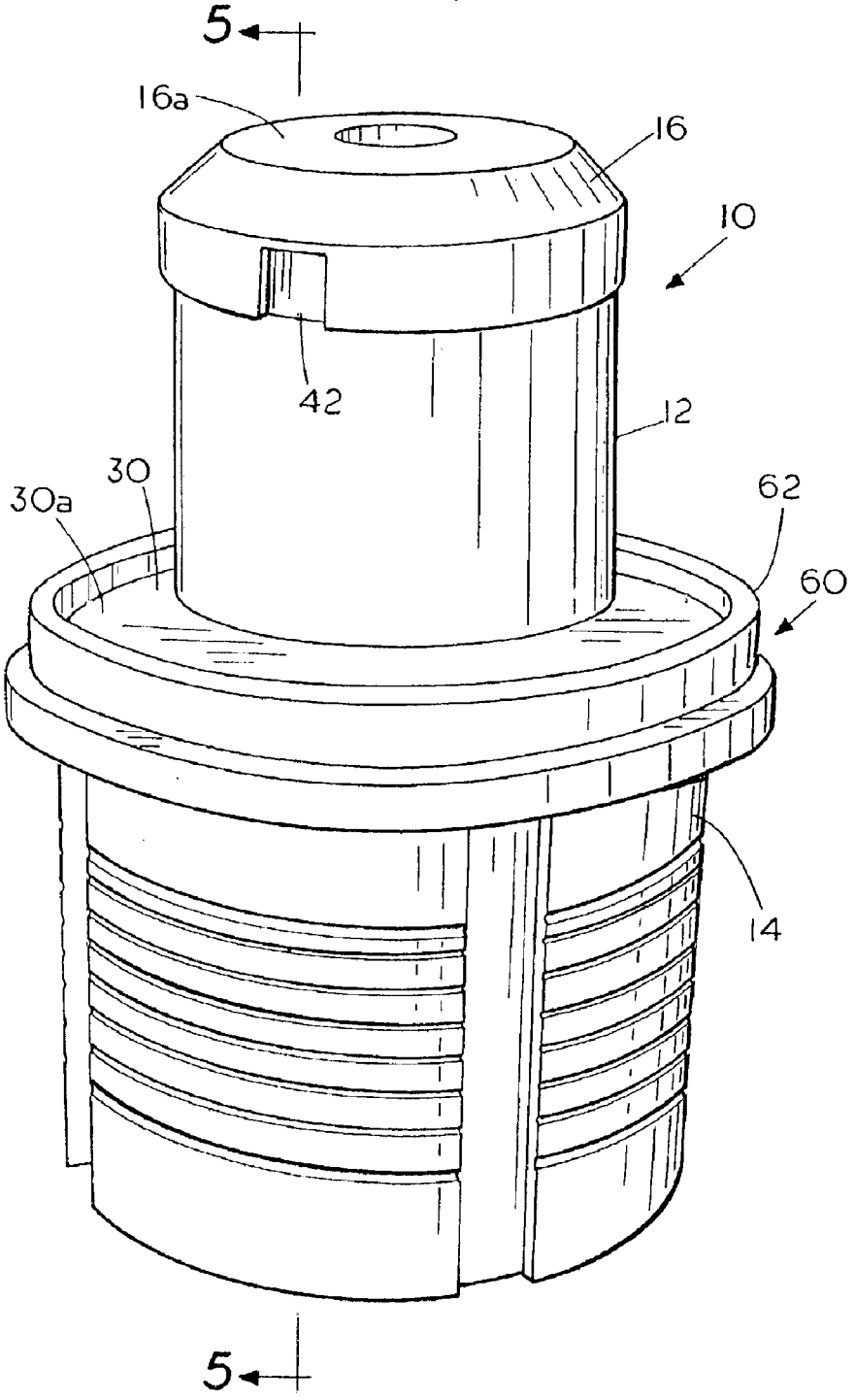

This invention relates to sheet forming equipment and more particularly to the punch and die art.

BACKGROUND OF THE INVENTION

In the punch and die art and particularly in the field of high-speed automated forming and punching equipment for punching and forming sheet material, e.g., sheet metal and especially in the case of automated turret punch presses, the punch presses are operated by computer to perform a series of punching or forming operations sequentially. These punch presses which by themselves form no part of the present invention are typically provided with an upper turret and lower turret that rotate and are indexed intermittently between punching operations. The turrets may, for example, hold as many as a dozen or more separate punches that are used in sequence for performing given operations. The distance between the replaceable upper metal forming insert or punch and the die which is held by the lower turret can be referred to as the "feed gap." The feed gap is an important factor because the workpiece may have one or more upward or downward projections which must be cleared by the punch insert when the turrets rotate or the workpiece is repositioned. Thus, if a projection extends an inch above the top of the workpiece, the lower end of the punch insert must be slightly more than an inch above the workpiece in order to clear the extension when the turret is rotated or the workpiece is repositioned. Heretofore, the height of any projection was limited by the feed gap.

In view of these and other deficiencies of the prior art, it is one object of the invention to provide an improved punch assembly having a provision for assuring that the lower or working end of the punch will not strike obstructions when moved laterally relative to the workpiece following a punching operation. It is another object of the present invention to provide an improved punch assembly that provides an effective feed gap control for changing as well as increasing the distance between the working end of the punch and the workpiece, that is to say, for increasing the feed gap.

Yet another object of the invention is to provide an improved punch assembly of the type that is suspended from a supporting flange.

Still another object of the invention is to provide an improved punch assembly which includes a circumferentially extending supporting flange with a feature for automatically retracting the upper forming tool or punch while maintaining a constant distance between the top of the punch assembly and the bottom of the punch insert.

These and other more detailed and specific objects of the present invention will be better understood by reference to the following figures and detailed description which illustrate, by way of example, but a few of the various forms of the invention within the scope of the appended claims.

SUMMARY OF THE INVENTION

This invention provides an improved punch assembly having a circumferentially extending, horizontally disposed supporting flange that is slideably mounted upon the body of the punch assembly as a part thereof for supporting the punch assembly with a resilient tool retractor, e.g., one or more springs connected to the flange for retracting or elevating the body of punch assembly relative to the supporting flange. Provision is also made that enables the press operator to change the form height or depth, consequently changing the feed gap from the exterior of the punch assembly by controlling the distance that the upper forming tool, i.e., the punch, extends downwardly below the supporting flange and for locking it securely in a selected position. The term "form" herein refers to the reshaped portion of the workpiece.

THE FIGURES

FIG. 1 is a perspective view of one preferred form of the present invention

Figure 2:
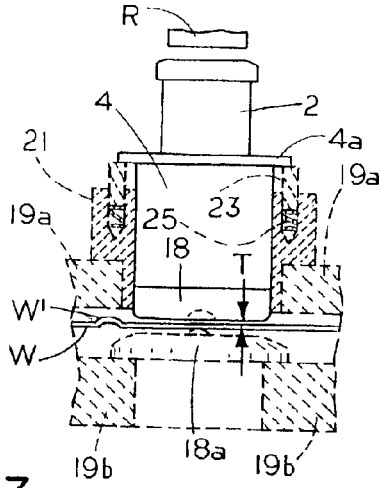
FIG. 2 PRIOR ART
Figure 3:
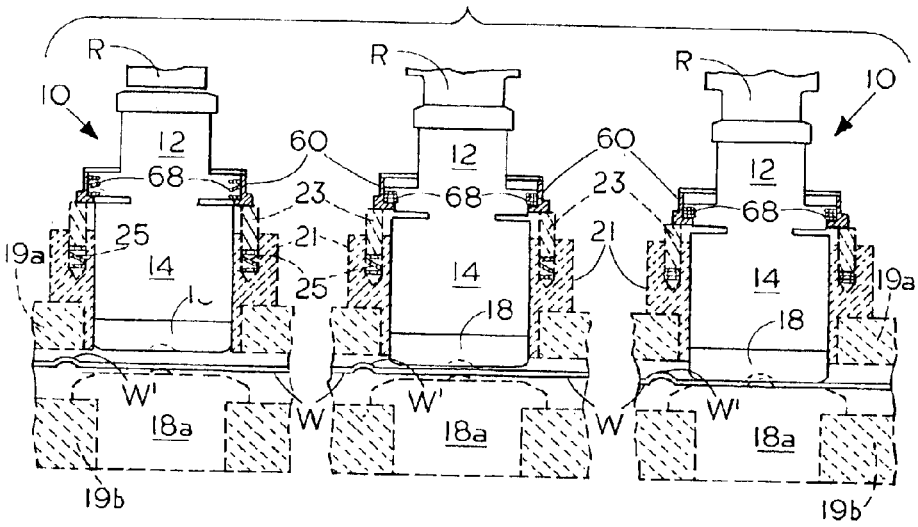
Figure 4:
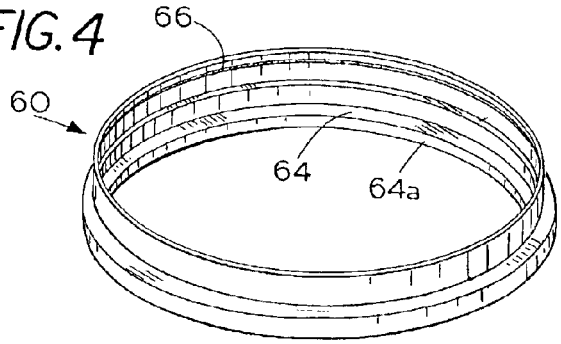
Figure 5:
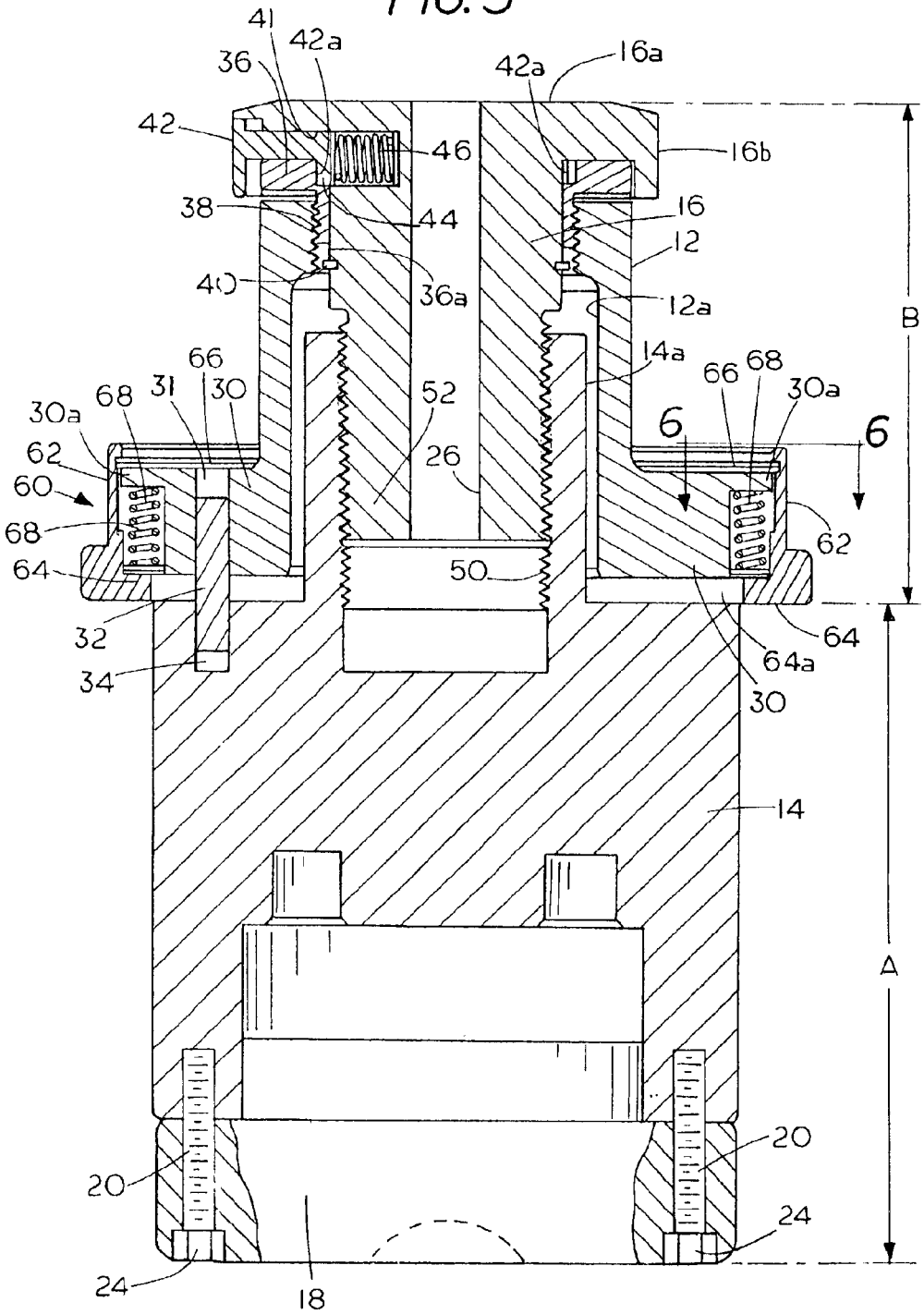
Figure 6:
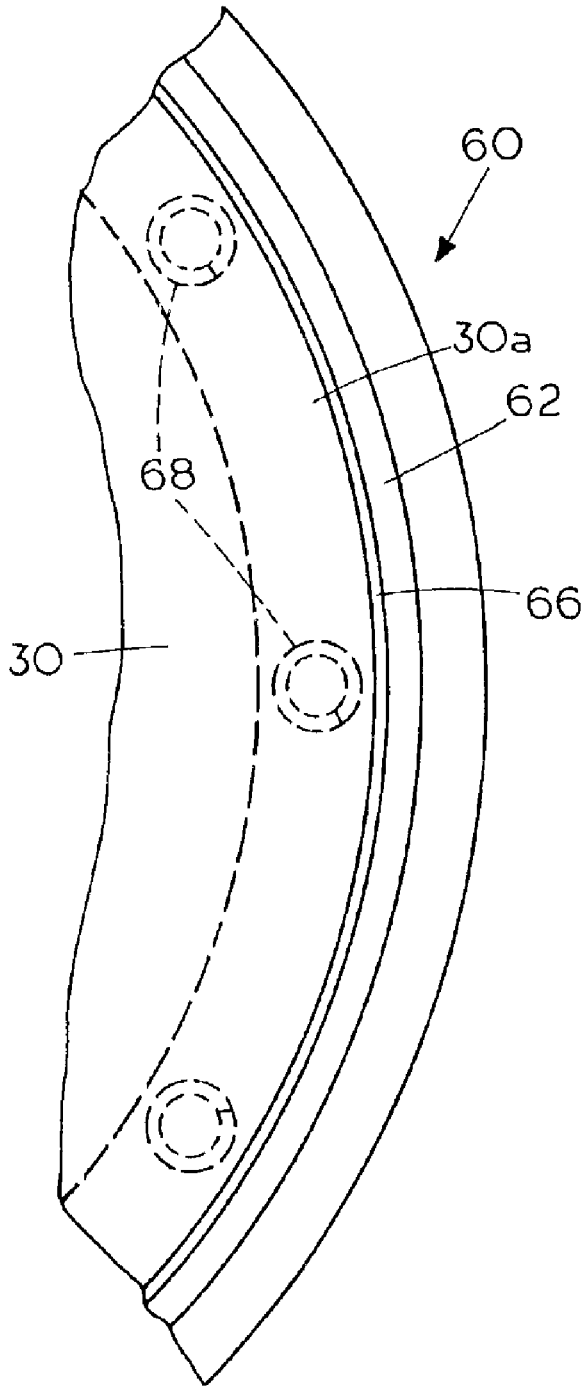

FIG. 2 is a side elevational view partly in section of a prior art punch assembly and punch press FIG. 3 is a side elevational view of the punch assembly and press showing three stages of operation proceeding from left to right in sequence as the punch assembly is moved downwardly when struck by the ram FIG. 4 is a perspective view of the moveable supporting flange FIG. 5 is a vertical cross-sectional view of the punch assembly taken on line 5—5 of FIG. 1 and FIG. 6 is a partial horizontal sectional view taken on line 6—6 of FIG. 5

DETAILED DESCRIPTION OF THE PREFERRED EMBODIMENT

Shown in FIG. 2 is a punch assembly 2 in accordance with the prior art having a cylindrical punch body portion 4 provided with an integral horizontally disposed circumferentially extending supporting flange 4*a* that rests during use on a plurality, e.g., four circumferentially arranged lifting posts, only two of which are shown, which are themselves resiliently supported upon lifter springs 25 recessed within a standard tool holder 21 which is part of conventional punch press having an upper turret 19*a* that is rotatably mounted in conjunction with a lower turret 19*b*. In a typical automated turret press, the turrets are rotated or the workpiece is indexed intermittently in a horizontal plane. Between each indexing advance of the turret 19*a*, the ram strikes one of the punch assemblies 12 to perform a punching operation. Within the lower punch assembly 19*b* is a die 18*a* that cooperates with the upper replaceable forming tool or punch 18 to make a hole or otherwise form the workpiece W to the desired shape. The distance T between the punch 18 and the die 18*a* can be referred to as the feed gap. It can be seen that the height of the lifter springs 25 will determine the feed gap T when the punch assembly 12 is at rest, i.e., between punching operations.

Refer now especially to FIGS. 1 and 5 which illustrate a preferred form of the present invention. Shown in the FIGS. 1 and 5 is an improved punch assembly indicated generally by the numeral 10 which includes a cylindrical length adjustment sleeve 12 having a hollow central bore 12*a* that surrounds the upper part of a cylindrical tool holder 14 which has an internally threaded tubular extension 14*a* into which is threaded a punch head 16. The punch head 16 includes an upwardly directed face 16*a* which is struck by the ram of the punch press each time the punch assembly 10 is operated. Removably secured to the bottom of the punch assembly by two socket head cap screws 20 is a replaceable forming tool or punch insert 18. Screws 20 extend axially through the punch insert 18 and are accessible from the bottom of the punch insert 18*a*.

Rigidly connected to the length adjustment sleeve 12 by means of screw-threads 38 is a circular lock collar 36 with a central bore 36*a* rotatably mounted upon the upper part of the tool head 16. The upper end of the tool head 16 is preferably enlarged to serve as a length adjustment knob 16*b* for manually changing the tool extension as will be described below. The tool head 16 is provided with a single horizontal bore 41 that supports a laterally slideable lock button 42 which is yieldably biased in an outward direction by means of compression spring 46 abutting its inner end. To retain the tool head 16 securely in any of several selected positions the lock collar 36 is provided with a plurality, e.g., 20 circumferentially spaced apart inwardly facing locking grooves 42*a* (only two of which are shown) to accommodate a locking tab 44 that extends downwardly from the lock button 42. On the tool head 14 positioned somewhat below the lock collar 36 is a circumferentially extending snap ring 40 for preventing unintentional separation of the parts.

The length adjustment sleeve 12 is provided at its lower end with a circular enlargement 30 that serves as a support for a circumferentially extending punch assembly supporting flange 60 which is slideably mounted upon the punch assembly as a part thereof for longitudinal sliding movement thereon. The moveable flange 60 is normally held in the resting position, i.e., when the punch is inactive as shown in FIG. 5 by a resilient retraction means, e.g., plurality of vertically disposed circumferentially distributed tool retractor springs 68, three of which are shown in FIG. 6 that are captured between a circular shoulder 30*a* that extends laterally from the enlarged portion 30 of sleeve 12 and a circular centrally extending lip 64 of the moveable flange 60. Any other suitable resilient means can be used such as a rubber ring or a circular leaf spring having a sine wave shape as seen in elevation. The sleeve 12 and the tool holder 14 are provided with aligned bores 31 and 34 respectively to accommodate a dowel pin 32 which is slideably mounted therein to maintain the sleeve 12 and the tool holder 14 in circumferential alignment while allowing them to move longitudinally relative to one another. The lip 64 has a central bore 64*a* that is slightly larger than the tool holder 14 to accommodate its upper end. The moveable flange 60 has a vertically disposed sidewall 62 that is grooved internally for a retaining ring 66 which holds the flange 60 in place as a part of the punch assembly 10.

Just prior to use, the punch press operator determines the required tool length (A+B of FIG. 5) necessary to create the required form W' (FIG. 3) that extends upwardly from the workpiece W. The machine operator then presses the lock button 42 disengaging the locking tab 44*a* which allows the length adjustment knob 16*b* to be turned freely by hand. As the knob 16*b* is turned, the tool holder 14 will begin to extend downwardly. When the desired position is reached, the lock button is released, allowing the lock tab 44*a* to enter one of the grooves 42*a* thereby securely locking the punch head 16 in place which in turn enables the extension distance A of the forming tool to be controlled as desired from outside the punch assembly to assure that the proper form is created.

With reference to FIG. 3 it will be seen at the left of the figure that before the ram strikes the top of the punch head 16, the tool holder 14 will be fully retracted by the retraction springs 68. The lifter springs 25 have also raised the tool lifting posts 23 to the fully elevated position. At the center of the figure in the next stage of operation, when the ram first strikes the punch assembly 10, the flange 60 will begin to rise on the punch assembly as the retractor springs 68 are compressed. The lifter springs 25 may also be somewhat compressed. Finally, as shown at the right in FIG. 3 with the ram fully extended, the punch assembly will be all the way down in its lowermost position so as to punch a hole or otherwise form the workpiece W by forcing it onto the die 18*a*. The ram R then releases the punch assembly 10 allowing springs 68 and flange 60 to return again to the position at the left in FIG. 3 so that the lower end of the punch will clear any obstruction defined by form W' that may be present as the turrets are indexed laterally or the workpiece is repositioned.

It should be noted that the feed gap T of the prior art (FIG. 2) is determined solely by the action of the lifter springs 25 however, in the present invention, the distance that the tool assembly is retracted is the sum of two distances; the distance that it is elevated by the resiliency of the tool retractor springs 68 which slides the supporting flange 60 axially as well as the distance that the tool assembly 10 is elevated by the lifter springs 25 and it is the capability of retracting the tool the sum of these two distances that enables the present invention to clear greater obstacles than was possible with the prior art yet the sum of distances A & B remain unchanged. This makes it possible to provide a greater feed gap with no change to press ram stroke length. The invention, thus, makes it possible to operate under conditions in which a punch assembly of the prior art as shown in FIG. 2 is unsuitable. In addition, turning of the length adjustment knob 16 enables the tool extension distance A to be varied as desired at any time from the exterior of the punch assembly 10.

Many variations of the present invention within the scope of the appended claims will be apparent to those skilled In the art once the principles described herein are understood.

What is claimed is:

1. A punch assembly for forming a workpiece comprising, a punch assembly, said punch assembly including a vertical sleeve with a central bore, a tool holder mounted for axial movement therethrough, a ring-shaped circumferentially extending supporting flange encircling the punch assembly and slidably mounted thereon such that the punch assembly as a whole is slideable axially within the flange, the flange being spaced apart from a lower end of the punch assembly and is devoid of a guide bushing around the tool holder, the sleeve having an outwardly projecting shoulder, at least one retractor spring is connected between the shoulder of the sleeve and the flange for yieldably biasing the flange downwardly on the punch assembly, a retainer connected to the flange for holding the flange in place on the sleeve and for enabling the flange to be removed from the sleeve, said tool holder extending downwardly during use toward the workpiece from the flange and an extension control for changing the distance that the tool holder extends below the supporting flange, such that the form height or depth of the workpiece can be set at a selected value while maximizing a gap between a tool held by the tool holder and the workpiece.

2. The punch assembly of claim 1 wherein the tool holder is connected to an upper portion of the punch assembly by a screw-threaded connection for changing the extension thereof below the flange.

3. A punch assembly for forming a workpiece comprising, a punch assembly, said punch assembly including a vertical sleeve with a central bore, a tool holder mounted for axial movement therethrough, a ring-shaped circumferentially extending supporting flange encircling the punch assembly and slidably mounted thereon such that the punch assembly is slideable axially within the flange, the flange being spaced apart from a lower end of the punch assembly and is devoid of a guide bushing around the tool holder, at least one retractor spring is connected between the sleeve and the flange for yieldably biasing the flange downwardly on the punch assembly, a retainer connected to the flange for holding the flange in place on the sleeve and the flange being removable from the sleeve, said tool holder extending downwardly during use toward the workpiece from the flange and an extension control for changing the distance that the tool holder extends below the supporting flange, such that a form height or depth of the workpiece can be established while maximizing a gap between the tool holder and the workpiece, and the tool holder is connected to a part of the punch assembly by a screw-threaded connection for changing the extension thereof below the flange.

4. The punch assembly of claim 3, including a lock operatively connected to the punch assembly for locking the extension of the tool holder in any of a plurality of selected positions.

5. For use in a punch press having a punch assembly therein for forming a depression or projection in a workpiece, the improvement comprising, a punch assembly including a vertical sleeve with a central bore, a tool holder mounted for axial movement therethrough, a ring-shaped circumferentially extending supporting flange encircling the punch assembly and slidably mounted thereon such that the punch assembly is slideable axially within the flange, the flange being spaced apart from a lower end of the punch assembly and the flange is devoid of a guide bushing around the tool holder, at least one retractor spring is connected between a portion of the sleeve and the flange for yieldably biasing the flange downwardly on the punch assembly, a member on the assembly for holding the flange in place on the sleeve, the flange being removable from the sleeve, said retractor spring urging the flange downward relative to the punch assembly so as to retract the punch assembly from an extended operating position that is taken to form the workpiece when the punch assembly is struck by a ram mounted on the punch press above the punch assembly.

6. The apparatus of claim 5, wherein the retractor spring comprises at least one piece of resilient material.

7. The apparatus of claim 5 wherein the retractor spring comprises a plurality of vertically disposed circumferentially spaced apart retraction springs connected to the flange.

8. The apparatus of claim 5 wherein the retractor spring comprises a circular leaf spring.

9. The apparatus of claim 5, wherein the punch assembly has an upper portion and the tool holder is at a lower end thereof and is movably connected to the upper portion for changing the extension thereof below the flange.

10. The apparatus of claim 9, wherein the lower end of the punch assembly is connected to the upper portion thereof by a screw threaded connection for changing the extension thereof below the flange.

11. The combination of a punch press and a punch assembly adapted to be mounted thereon comprising, a punch press having an upwardly extending downwardly yieldable punch assembly holder that includes at least one lifter spring as a part of the punch press for elevating a punch assembly supported thereby, said punch assembly including a vertical sleeve with a central bore, a tool holder mounted for axial movement therethrough, a circumferentially extending flange encircling the punch assembly and being slidably mounted thereon as a separate ring such that the punch assembly is slideable axially within the flange, at least one retractor spring is connected between the sleeve and the flange for yieldably biasing the flange downwardly on the punch assembly, and a retainer for holding the flange in place on the sleeve such that the punch assembly is yieldably biased upwardly by both the lifter spring of the punch press and the retractor spring of the punch assembly for maximizing a gap between the tool holder and a workpiece.

12. The apparatus of claim 11 including an extension control for changing the distance that the tool holder extends below the supporting flange such that the form height or form depth of a workpiece can be established while maximizing said gap between the tool holder and the workpiece.

13. The apparatus of claim 11 wherein the tool holder is connected to a portion of the punch assembly by a screw-threaded connection for changing the extension thereof below the flange.

14. The apparatus of claim 11 including a lock operatively connected to the punch assembly for locking the extension of the tool holder from an upper end of the punch assembly in any of a plurality of selected positions.

15. The apparatus of claim 11 wherein said retractor spring comprises a plurality of vertically disposed, circumferentially spaced apart helical retraction springs connected to the flange.

* * * * *